US008316991B2

(12) United States Patent
Akselsen et al.

(10) Patent No.: US 8,316,991 B2
(45) Date of Patent: Nov. 27, 2012

(54) DEVICE OF AN EVACUATION SYSTEM

(75) Inventors: Bjørn T. Akselsen, Søreidgrend (NO); Steinar Arefjord, Brattholmen (NO); Lars Bjoland, Ågotnes (NO); Magne K. Oen, Bergen (NO)

(73) Assignee: Viking Life Saving Equipment, Skogsvag (NO)

( * ) Notice: Subject to any disclaimer, the term of this patent is extended or adjusted under 35 U.S.C. 154(b) by 1034 days.

(21) Appl. No.: 10/569,996

(22) PCT Filed: Aug. 30, 2004

(86) PCT No.: PCT/NO2004/000256

§ 371 (c)(1),
(2), (4) Date: Jan. 3, 2007

(87) PCT Pub. No.: WO2005/021371

PCT Pub. Date: Mar. 10, 2005

(65) Prior Publication Data

US 2007/0119654 A1 May 31, 2007

(30) Foreign Application Priority Data

Aug. 29, 2003 (NO) ..... 20033836

(51) Int. Cl.
*B63C 9/22* (2006.01)

(52) U.S. Cl. ..... 182/48; 114/365; 114/366; 114/375; 414/143.1; 441/80

(58) Field of Classification Search ..... 182/48; 114/375, 365, 366; 414/143.1; 441/80
See application file for complete search history.

(56) References Cited

U.S. PATENT DOCUMENTS

| | | | | | |
|---|---|---|---|---|---|
| 550,310 | A | * | 11/1895 | Woodward | 193/25 R |
| 908,034 | A | * | 12/1908 | Pyleck | 193/25 R |
| 2,955,299 | A | * | 10/1960 | Ingram, Jr. et al. | 114/362 |
| 3,433,323 | A | * | 3/1969 | Ukawa et al. | 182/48 |
| 3,580,358 | A | * | 5/1971 | Yamamoto | 182/48 |
| 3,826,335 | A | * | 7/1974 | Allen | 182/10 |
| 3,994,366 | A | * | 11/1976 | Okuma et al. | 182/48 |
| 4,005,762 | A | * | 2/1977 | Zephinie | 182/48 |
| 4,099,595 | A | * | 7/1978 | Tracy | 182/48 |
| 4,154,320 | A | * | 5/1979 | Jatczak | 182/48 |
| 4,162,717 | A | * | 7/1979 | Orii et al. | 182/48 |
| 4,240,520 | A | * | 12/1980 | LaGrone et al. | 182/48 |
| 4,398,621 | A | * | 8/1983 | Baker | 182/48 |
| 4,582,166 | A | * | 4/1986 | Baker | 182/48 |
| 4,595,074 | A | * | 6/1986 | Nordtvedt | 182/48 |

(Continued)

FOREIGN PATENT DOCUMENTS

GB 1419518 * 12/1975

*Primary Examiner* — Alvin Chin Shue
*Assistant Examiner* — Colleen M Chavchavadze
(74) *Attorney, Agent, or Firm* — Francis C. Hand; Carella Byrne, et al

(57) ABSTRACT

There is disclosed a device of an evacuation system, in particular a foldable evacuation means which is arranged to be lowered from a parked folded up position on the vessel to be evacuated to stretched out position on a rescue device, the bottom section of which including a weight device to keep the evacuation means sufficient extended in use position, an including a set of one or more cables/wires connected to a winch arrangement for lowering and lifting the evacuation means. The evacuation device is characterized in that the weight device is arranged to be positioned on the rescue device, and the system includes means to compensate for varying distances between the vessel to be evacuated and the rescue vessel.

2 Claims, 7 Drawing Sheets

CONCEPT 2

U.S. PATENT DOCUMENTS 4,602,697 A * 7/1986 Aanensen ..... 182/48
4,946,018 A * 8/1990 Binzen et al. ..... 193/25 C
5,135,076 A * 8/1992 Su ..... 182/48
6,102,762 A * 8/2000 Bell et al. ..... 441/80
6,467,575 B1 * 10/2002 Chen ..... 182/48
6,892,857 B2 * 5/2005 Baker ..... 182/48
7,159,527 B2 * 1/2007 Nielsen ..... 114/230.2
7,556,124 B2 * 7/2009 Hafliger ..... 182/48

* cited by examiner

PRIOR ART FIG 1

CONCEPT 1

CONCEPT 2

CONCEPT 3

CONCEPT 4

CONCEPT 5

DEVICE OF AN EVACUATION SYSTEM

The present invention relates a device for securing an evacuation system, such as a rescue stocking, when operated.

There is described the work, conclusions and recommendations from the concept development project, evacuation system, in particular for frozen waters. Following the developing, 5 main concepts have been evaluated further. Due to time and reliability, it is recommended to keep as much as possible of well-known and tested system elements. The main system recommended for further development and engineering is a system much based on an existing chute evacuation system, but with a counterweight implemented on the winch wires to keep them and the chute tight in all conditions.

A system as disclosed in the preamble is known from international patent specification WO 94/01324. The winch wires to which the rescue stocking is sliding connected, is kept stretched out by means of the bottom frame connected to the end of the winch wire. The frame extends down below the water surface. The weight of the frame provides for a constant tension of the winch wires.

Reference is also made to international patent specification WO 95/35233.

It is an aim of the invention to present a new structure for obtaining said constant tension of the winch wires.

It is also an aim of the invention to present a new structure where no elements are to be positioned below the sea surface. This may be the case where the evacuation system is to be used in frozen waters.

The system of the present invention is characterised by the features appearing in the characterising clause of claim 1.

Preferably a winch arrangement includes means to obtain a constant tension of the cable with the evacuation means in its use position.

Further preferred embodiments of the system of the present invention appear in the dependent system claims.

The purpose of the invention in this document is to provide for a evacuation system which may be suitable for offshore platforms operating in frozen waters. The idea behind the project is to be able to evacuate to sea level 100 as shown in FIG. 1, into a system also suitable for evacuation directly to the deck of a vessel in cold and icy conditions. The summer use of the system is planned to be identical to the standard system today with deployment to the sea. The winch 36 will then lower the stabilising weight 13 with the life rafts 101 and boarding platform 102 to sea level 100 where the life rafts 101 floats off and the boarding platform 102 automatically inflates. The stabilising weight 13 continues into the sea to a safe distance underneath the boarding platform 102 and the sea level. The sunken weight 13 keeps the stabilising wires 103 (three shown in FIG. 1) tight thereby keeping the chute 27 and the boarding platform 102 in position. FIG. 1 also shows the platform deck 104, and the entrance door 105 to the boarding platform 35 in the rescue zone 106. As shown, the collapsible chute is guided freely slidingly connected to the three (or more) winch wires.

1. Objective

The objective of this work has been to, through a development process, find, evaluate and recommend possible modifications to existing SES-2A chute evacuation system to make this system suitable for evacuation also in frozen waters. The system is required to be operational in both summer and arctic winter conditions.

1 Main Challenges

During the first brainstorming meetings, the main challenges were identified and noted:

Keep the chute tight in all conditions of wind, wave and vessel movement.

Operation in low temperatures.

When lowered to deck of a ship, keep the stabilising weight in a fixed position on the deck When lowered to deck of a ship, avoid any complicated interface to the ship.

When launched to sea, still operate without influence of the modifications

Avoid requirement for external power.

Avoid any permanent extensions below the system floor.

Allow a safe and efficient exit from the chute to the deck of the ship.

Allow a quick and safe disconnection between the deck of the ship and the chute.

2 Concept Categories

Initially a total of 28 different ideas and solutions were evaluated. The different ideas were first sorted and grouped into which problem they were planned to solve or contribute to solve:

a) Keep chute tight
b) Power supply
c) Fix stabilisation weight on the deck
d) Exit from chute to deck
e) System release from deck Most of the ideas were related to how to keep the chute tight when evacuating to the deck of a ship. These ideas were again sub grouped into principle of function:

1. Active systems
2. Counter weight systems
3. Spring based systems
4. Bungy cord systems Another grouping method was also employed. The different ideas were sorted by the method they use to sideways position the chute:

1. Chute guided on tight stabilising wires
2. Chute kept in position of inclined elastic ropes
3. Elastic chute 3 Decision Criteria.

The list of suggestions was now gradually reduced through a filtering process. The filter used in this process was a list of criteria that was discussed and agreed by the core team. Every suggestion and concept was compared to each criterion on the criteria list. Only those suggestions that passed the criteria were brought further. A second way of filtering that was used was to compare in detail suggestions having similar characteristics and choosing the better of the two alternatives. The filtering processes were continued until only 5 of the original suggestions and ideas were left. The criteria used were as follows:

1. Avoid any solution not based on the principle of tight stabilising wires.
   As we know the system today, to keep the chute guiding wires tight is essential. To keep the chute sideways in position by use of tight stabilising wires is a well-known and tested system. All tested versions till now are based on this. Any other solution will require extensive testing to avoid introduction of unreliable elements.
2. Avoid systems that require modifications of the ship or require special equipment to be available on the ship.
   It was a common opinion of the core team that it would be unwise to limit the connection of the system to special designed or special equipped ships.
3. Avoid dependence on external electric power.
   Even if the external power source were reliable and redundant, the cables connecting the system to this source would still have to be regarded as vulnerable and the team concluded, based on this, self supplied systems to be more reliable.

4. Avoid systems based on elastic cord or bungy.

Again, this was decided due to lack of information and reliable data about previously non-tested components. Implementation of new and untested materials would require extensive testing to be brought up to an acceptable level of reliability. Uncertainties were mainly related to behaviour in cold environments.

5. Comparison of counter weight principles

Two of the suggestions left in this stage were pure counterweight systems. One of the systems had the counterweight hanging in the end of the wire while the other had the counterweight hanging in one or more bights of the wire. Advantages and disadvantage were compared for these two systems. The conclusion showed that to arrange the counterweight in bights of the wires is preferable.

6. Elimination of one of two comparable systems

Two suggestions, which both were based on existing winch and wire system were compared. Both these systems could be designed to have stabilising wires which were static related to the chute when in operation. The system collecting the superfluous wire inside the stabilising weight was believed to have most disadvantages and was eliminated.

After this process, 5 concept suggestions were left in group a): "How to keep the chute tight"

The invention is to be disclosed in the following with reference to the drawing figures, wherein.

This section gives a description of each of the remaining 5 concepts. In this phase of the study, the engineers worked individually on the 5 concept suggestions with sketching and early stage design work. The purpose with this was to get a better understanding of each concept and discover any major technical problems with implementation of the concepts.

Figure 1:
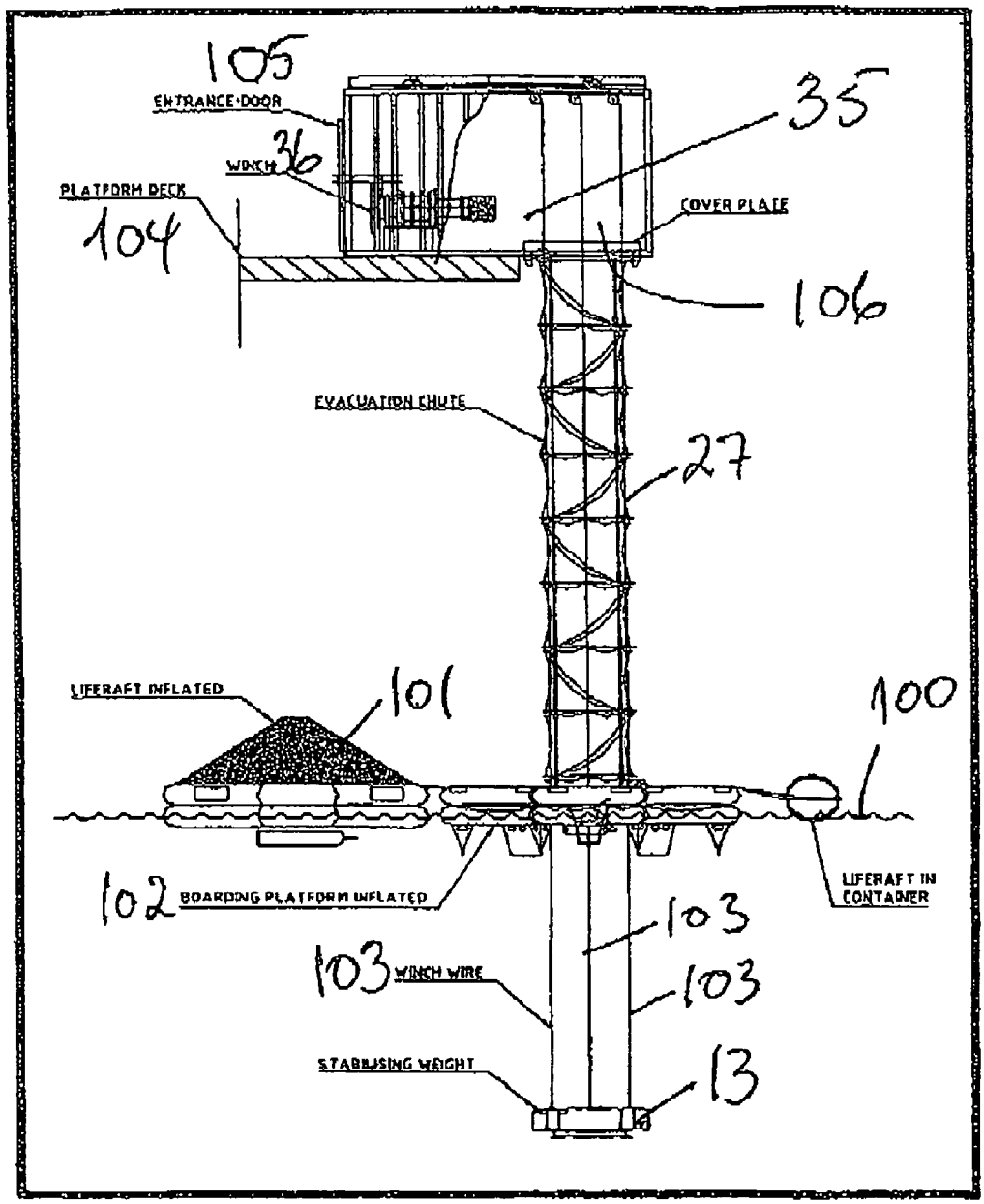
FIG. 1 shows a known system wherein the wire to which the evacuation means is connected, is kept stretched out by means of a stabilising weight connected to the end of the winch wire below the water surface, as disclosed previously in connection with the WO 94/01324.
Figure 2:
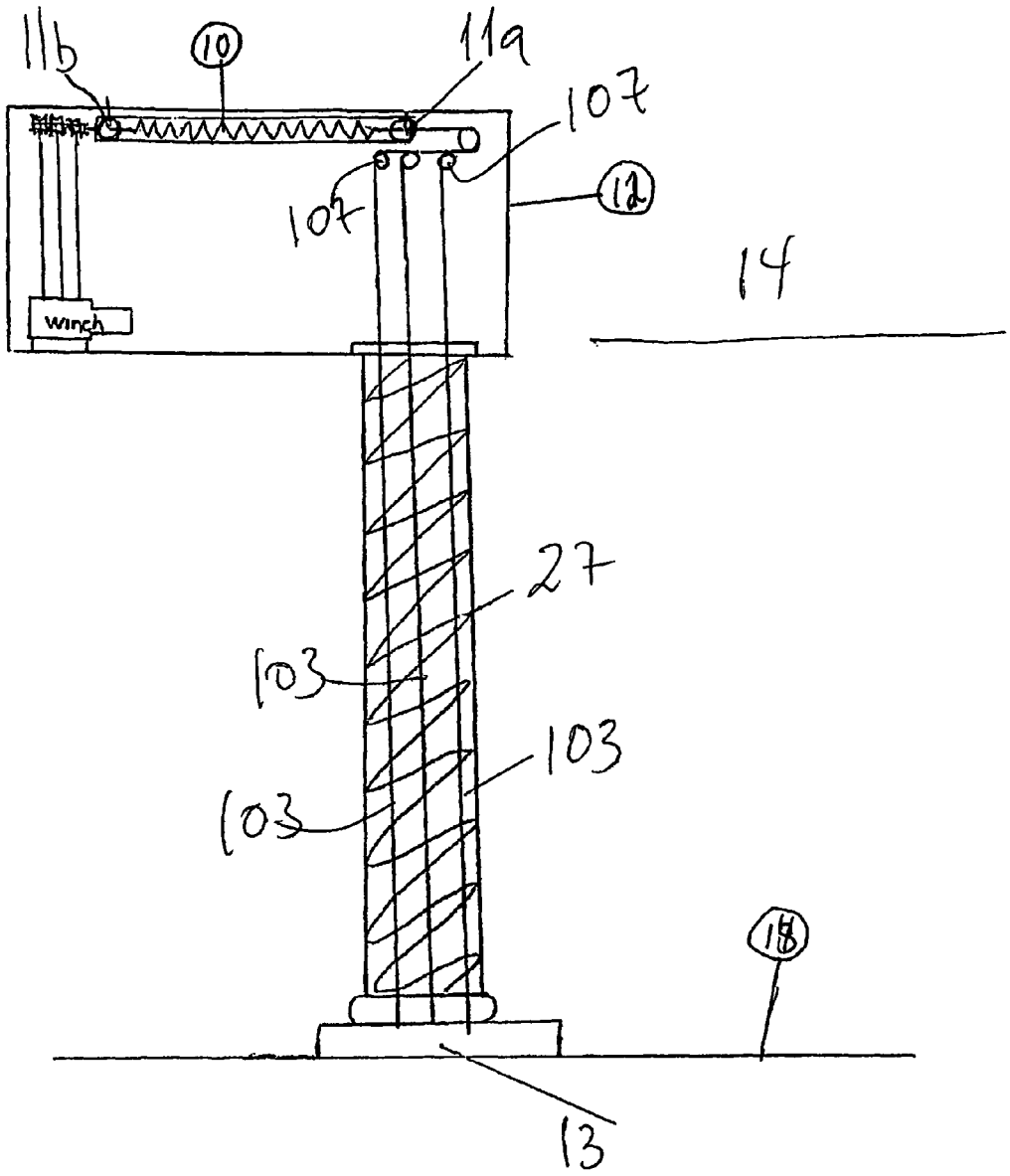
FIG. 2 shows a principle for the system wherein the weight means, according to the invention, has been installed on the deck of the vessel to be evacuated. The system includes a tackle system to compensate for the mutual different movements of a life raft and the rescuing vessel

3.1 Multiple Tackle System on the Winch Wires, Concept 1, FIG. 2.

The figure shows the stabilising weight connected to the winch wires 103. The chute is connected to the wires and weight element 13 as disclosed previously. The wires runs over pulleys to each ones tackle 11. Two tackle systems (first and second) 11*a* and 11*b* are mutually separated/expanded by a spring system 10, respectively. The wires from the tackle system 11*b* is connected to the winch drum. The multiple tackle with system of springs 10 expand the distance between the tackles 11 and by that is able to buffer the superfluous wire. The springs could be mechanical, hydraulic or pneumatic. See FIG. 2. The suitable position for the tackle system should be underneath the ceiling of the container 12 or housing for the whole system. The idea is that the springs are designed to apply a force to the tackle system that is sufficient low for the mass of the immersed stabilising weight 13 to counteract. By this the tackle system will stay compressed until the wires are unloaded by contact between the stabilising weight and the deck of the ship 14. From this point, the tackle system is compensating for the ship movement lifting and lowering down the stabilising weight. A critical operation during deployment would be to stop the winch when the tackles are in correct position.

Figure 3:
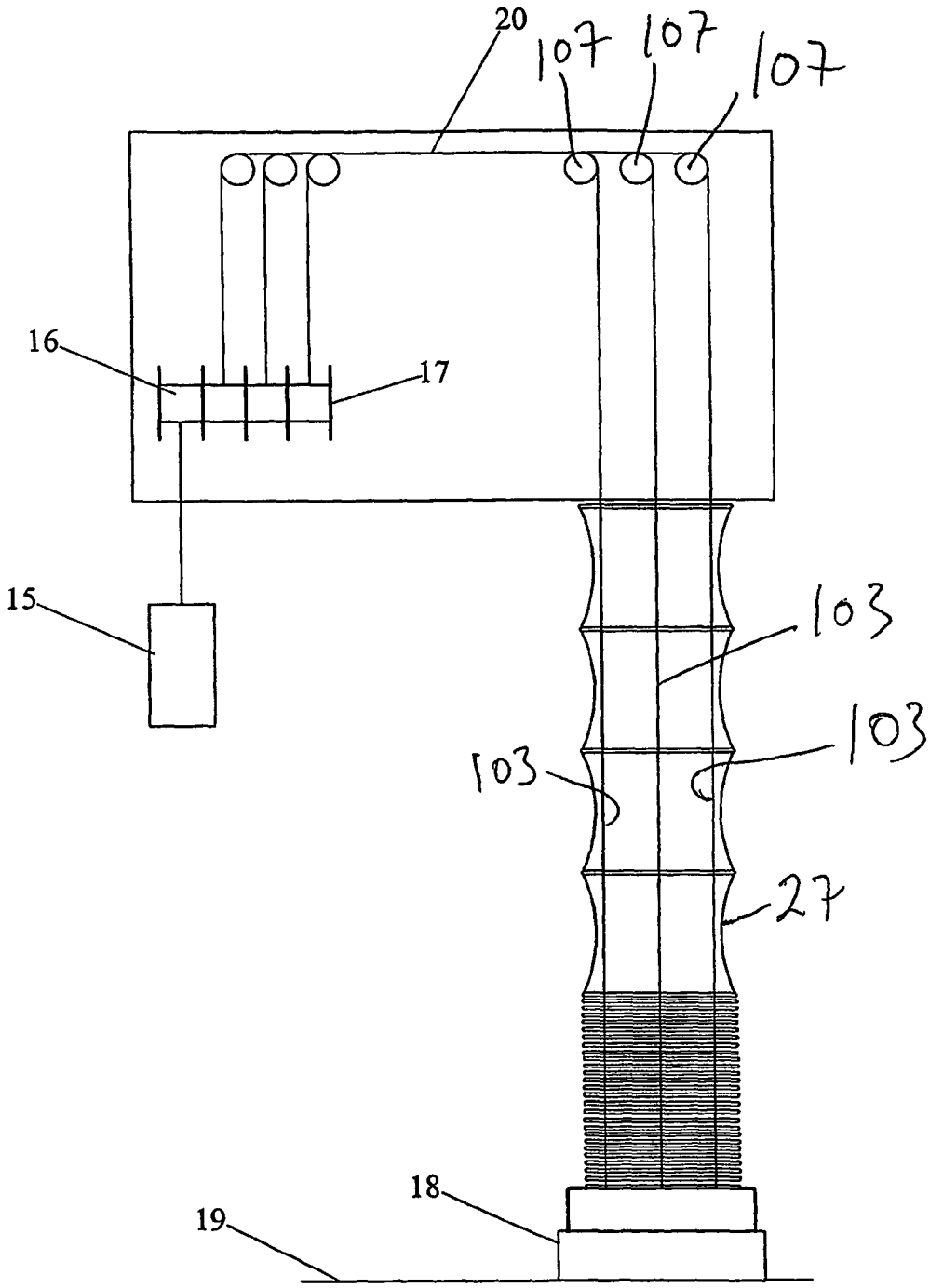
FIGS. 3 and 4 shows different embodiments of the idea of the present invention.

The following relates to the embodiments of FIGS. 2 and 3.

Positive points:

No requirement for external power

All the equipment is compact installed inside the container

Negative points:

Deployment must be stopped in correct position, manually or automatically

The winch drums must have capacity to hold much wire

Difficult to achieve sufficient compensation capacity.

Stabilising wires are moving relatively to the chute 3.2 Counterweight on Winch, Concept 2. See FIG. 3

This is a counterweight 15 that is connected to a separate shorter wire on a $4^{th}$ section 16 of the winch drum 17. While lowering, the counterweight is also first lowered until the $4^{th}$ drum is empty. Further lowering will start re-winding the $4^{th}$ drum and the counterweight will be hoisted up again to a middle level as the stabilising weight 18 hits the deck of the vessel 19. When in operation, the counterweight will try to rotate the now disengaged winch drum and keep the main wires 103/20 tight. The system requires that it is possible to disengage the winch drum. The deployment-to-deck procedure would include lowering to contact with the deck of the ship and then disengagement of the winch drum. The physical placement of the counterweight would be in a tower going through the roof of the container.

Positive points:

No requirement for external power

Simple and fail safe deployment procedure

Not sensitive to low temperatures.

Negative points:

Must be designed specifically for the actual evacuation height.

Container must be modified with tower for the counterweight.

The standard winch drum must be modified with an extra drum and it must be possible to disengage the total drum.

Stabilising wires are moving relatively to the chute.

Figure 4:
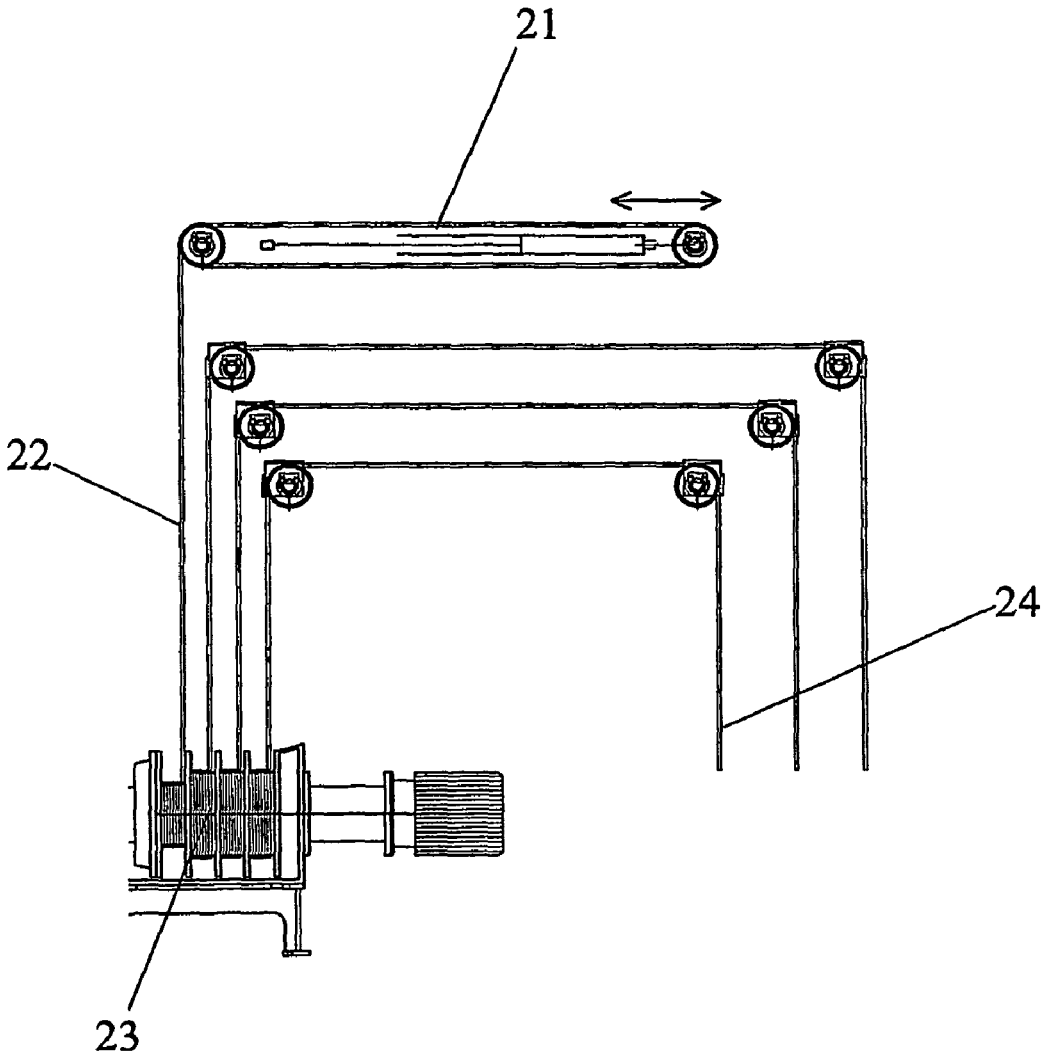

3.2 Tackle System Combined with a $4^{th}$ Winch Drum, Concept 3. See FIG. 4

This is a combination of concepts 1 and 2 above. In this case, the counterweight 15 in concept 2 is replaced by a tackle system 21 as described for concept 1. The loaded tackle system will introduce the required tension in the $4^{th}$ wire 22 to turn the disengaged winch drum 23 and keep the main wires 24 tight. In parked mode, the tackle system will be compressed. When lowering, the $4^{th}$ drum will unwind until empty and the tackle system is expanded to its maximum length. Then it will rewind and the tackle system will be compressed to a middle position as the stabilising weight touches the ships deck. The winch drum is then released from the winch brake system.

Positive points:
No requirement for external power
Simple and fail safe deployment procedure
All the equipment is inside the container
Negative points:
Must be designed specifically for the actual evacuation height.
Complex and not very service friendly. The standard winch must be modified. Stabilising wires are moving relatively to the chute.

Figure 5:
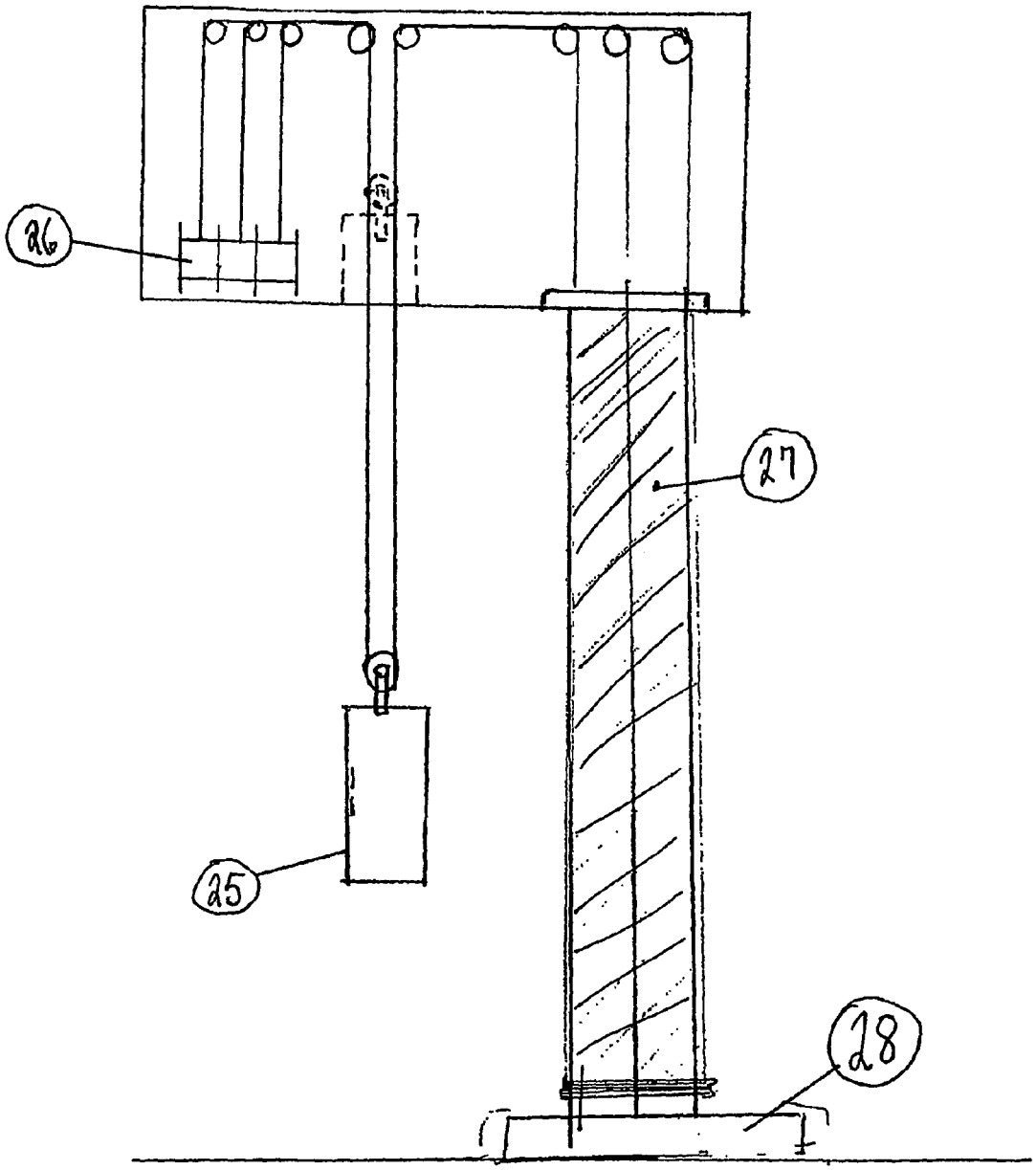
FIG. 5 shows another variant of the system as disclosed in FIG. 2.

3.3 Counterweight on the Main Wires, Concept 4. FIG. 5.

In this system, the counterweight 25 is hanging in bights of the wires between the winch drum 26 and the chute 27. The counterweight is moving vertically in a tower penetrating the roof of the container. To reduce vertical space requirement, the counterweight is connected to the system by means of multiple tackles. The mass of the counterweight would have to be adapted so that the immersed stabilising weight 28 is able to pull the counterweight to upper position. Only when the wires are unloaded by contact between the stabilising weight and the ship's deck 29, the counterweight will start moving downwards. As for concept 1, the critical operation during deployment will be to stop the winch when the counterweight is in the correct position. This may be solved by automatic activation of the winch brake system from a counterweight sensor.

Figure 6:
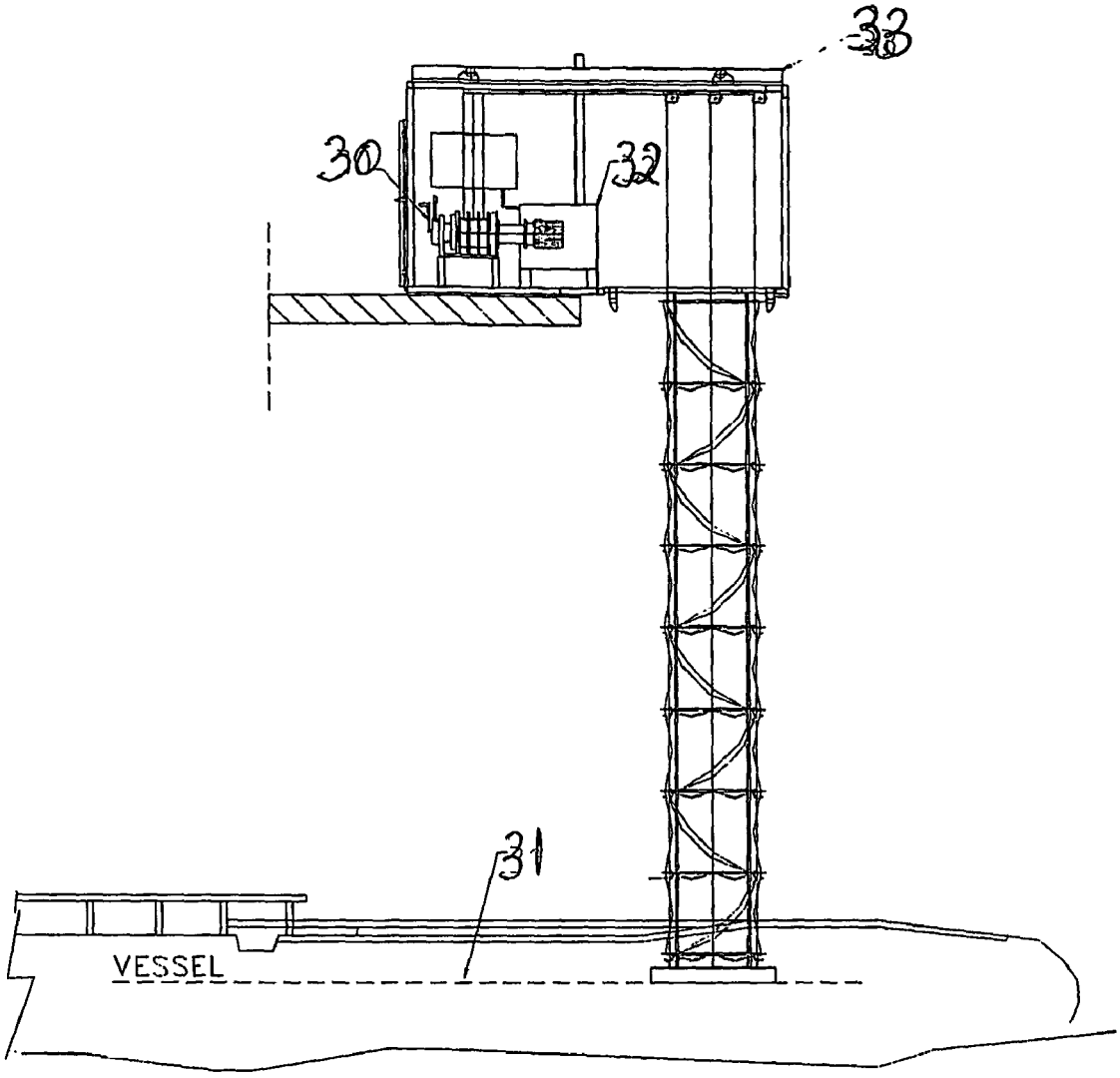
FIG. 6 shows another variant of the system wherein a constant tension winch 30 is used, including a diesel engine or hydraulic pump 32 to provide sufficient hydraulic pressure.

Positive points:
No requirement for external power
Flexible with respect to level of ships deck
Not sensitive to low temperatures
Negative points:
Deployment must be stopped in correct position
The winch drums must have capacity to hold much wire
Stabilising wires are moving relatively to the chute 4.5 Constant Tension Winch, Concept 5. FIG. 6.

This is a system, which is very similar to today's system, but the electrically powered standard winch is replaced with a constant tension hydraulic powered winch 30. In case of an evacuation to ship's deck 31, this system would not survive a power cut off and need to be fully self-sustained. Emergency power in electric or hydraulic form is supplied from a diesel engine driven unit 32 inside the system container 33. The deployment-to-ship procedure for this system would have to include automatic or manual switching to constant tension mode as soon as the hoisting wires are unloaded.

Positive points:
Simple deployment procedure.
Simple container design
Standard constant tension winch
Negative points:
Backup power required.
Complex and vulnerable system
Stabilising wires are moving relatively to the chute.

Figure 7:
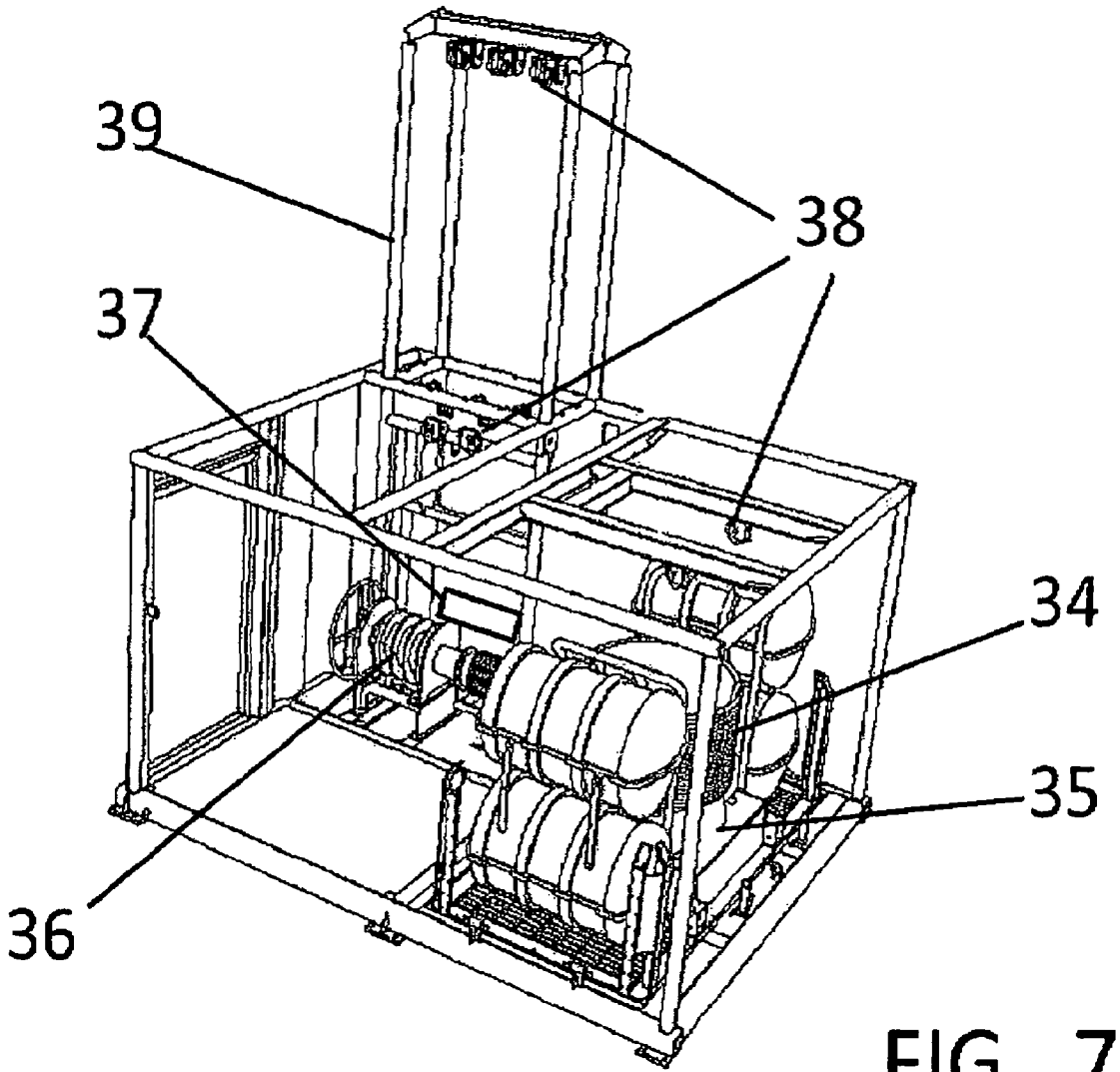
FIG. 7 shows a perspective sketch of the arrangement onboard the vessel to be evacuated 5. General Description and Ranking of the 5 Optional Concepts.

In FIG. 7 a perspective sketch of the arrangement onboard the vessel to be evacuated, is shown. Showing the evacuation chute 34, boarding platform 35, winch 36 and counterweights 37, and finally the pulley arrangement 38 mounted into a counter weight tower 39 onboard the ship/vessel.

As the result of an evaluation, a counterweight system having the counterweight in the bights of the wires, is the preferred concept for keeping the chute tight and positioned.

The invention claimed is:

1. An evacuation system for a vessel comprising
a foldable evacuation means for movement between a parked folded up position on the vessel to be evacuated and a stretched out use position beside the vessel;
a stabilizing weight in a bottom section of said evacuation means to maintain said evacuation means extended in said use position;
a winch having a drum and a plurality of wires connected between and to said drum and said stabilizing weight for lowering and lifting said stabilising weight and said evacuation means;
a counterweight; and
a further wire connected between and to said drum and said counterweight and being of a length shorter than each wire of said plurality of wires;
said winch being operable to selectively engage said drum for rotation thereof to lower said stabilizing weight and said evacuation means while simultaneously unwinding said plurality of wires from said drum and simultaneously unwinding said further wire from said drum and re-winding said further wire on said drum with continued unwinding of said plurality of wires from said drum and to thereafter disengage from said drum to permit rotation of said drum by said counterweight against the weight of said stabilizing weight and said evacuation means to maintain said plurality of wires tight.

2. An evacuation system as set forth in claim 1 wherein said evacuation means is a chute.

* * * * *